United States Patent [19]

Suster et al.

[11] Patent Number: 4,914,345

[45] Date of Patent: Apr. 3, 1990

[54] CORROSION RESISTANT BASE FOR ELECTRIC LAMPS

[75] Inventors: Albert L. Suster, Chagrin Falls; Winston T. Bachmann, Lyndhurst; Edward M. Beesley, Bedford Heights; John Gritti, Macedonia; Clifford W. Paugh, Diamond; William H. Sullivan, Sagamore Hills; Gene I. Thomasson, Chesterland, all of Ohio

[73] Assignee: General Electric Company, Schenectady, N.Y.

[21] Appl. No.: 164,145

[22] Filed: Mar. 4, 1988

[51] Int. Cl.[4] ..... H01J 5/52

[52] U.S. Cl. ..... 313/318; 313/25; 439/615; 420/469; 420/481; 420/485; 420/498

[58] Field of Search ..... 313/318, 25; 439/611, 439/613, 615, 616; 420/469, 481, 485, 498

[56] References Cited

U.S. PATENT DOCUMENTS

| | | | |
|---|---|---|---|
| 2,034,561 | 3/1936 | Davis | 420/498 |
| 3,775,634 | 4/1973 | Hassell et al. | 313/318 |
| 4,020,382 | 4/1977 | Bolt et al. | 313/318 |
| 4,044,277 | 8/1977 | Komyati | 313/318 |
| 4,496,874 | 1/1985 | Sander et al. | 313/318 |
| 4,586,967 | 5/1986 | Shapiro et al. | 420/470 X |

*Primary Examiner*—Donald J. Yusko
*Assistant Examiner*—Michael Horabik
*Attorney, Agent, or Firm*—Edward M. Corcoran; Stanley C. Corwin; Fred Jacob

[57] ABSTRACT

Metal lamp bases for electric lamps fabricated from certain relatively high copper and low zinc content copper alloys and lamps employing same are resistant to cracking in corrosive environments.

24 Claims, 2 Drawing Sheets

CORROSION RESISTANT BASE FOR ELECTRIC LAMPS

BACKGROUND OF THE INVENTION

1. Field of the Invention

This invention relates to copper alloy metal bases for electric lamps resistant to cracking in corrosive environments. More particularly, this invention relates to copper alloy metal lamp bases which are resistant to cracking in corrosive environments, and electric lamps containing same, wherein said copper alloy contains at least about 60 wt. % of Cu and less than 10 wt. % Zn, if Zn is present.

2. Background of the Disclosure

Electric lamps comprising an outer envelope of vitreous material with an electric light source accommodated in said envelope invariably have a metal base or cap provided on an end or stem portion of said envelope, with current supply conductors connected from the light source to the base. The base containing lamp is screwed, plugged, or otherwise inserted in an electric fixture for providing current to the lamp through the base. Generally, the outer envelope of the lamp is made of a vitreous material such as glass or quartz and has a stem or neck-shaped portion, which is generally a part of the lamp envelope and which generally, but not necessarily, has a diameter smaller than that of the light source containing portion of the lamp envelope. One end of the neck-shaped portion terminates in a base portion which contains the base or cap. The base or cap is at least partly metal and has an insulating portion to avoid electrical short circuits.

Such electric lamps include the well known bulb-shaped incandescent lamps, cylindrically shaped lamps, automobile or PAR lamps and various arc discharge lamps such as the high pressure sodium vapor arc discharge lamps which generally comprise a ceramic arc tube disposed within an outer vitreous envelope and metal halide arc discharge lamps wherein the arc tube is generally made of a vitreous material such as quartz or a high temperature glass disposed within an outer vitreous envelope. All of these lamps invariably have a metal end cap or base which is either screwed, cemented or otherwise connected to one end of the stem or neck-shaped portion of the lamp envelope. Some lamps are double-ended having two stems and, concomitantly, sometimes two bases. All of these various types of lamps are well known to those skilled in the art. Illustrative, but non-limiting examples of various types of metal lamp bases may be found in U.S. Pat. Nos. 3,775,634; 4,020,382; 4,044,277 and 4,496,874. More often than not, lamps currently manufactured have metal screw bases of standardized sizes for screwing into receptacles for supplying current to the light source.

Although various metals such as aluminum, zinc plated steel, brass plated steel, nickel plated steel and certain copper alloys have been suggested for use as lamp bases, relatively high zinc content copper alloys or brasses containing at least about 10% zinc have invariably been used for the manufacture of such lamp bases. These materials possess a combination of properties, including cost, electrical and thermal conductivity, formability, resistance to mechanical damage, relatively good corrosion resistance etc., which make them desireable for use in electric lamp bases. One particular copper alloy that has been widely used is a cartridge type of brass known as a C260 alloy which is nominally 70% copper and 30% zinc on a weight basis, with less than 1% of other alloying ingredients. Another brass alloy that has been used is a low brass C240 alloy which nominally contains 80% copper and 20% zinc. U.S. Pat. No. 4,496,874 discloses suitable copper alloys as including, on a weight basis, 45–67% copper, 12–45% zinc and 10–26% nickel along with the possible addition of minor amounts of various other alloying ingredients.

One of the problems encountered in the lamp industry is the cracking of such metal lamp bases both in storage and in service. Such cracking is exhibited as cracks both parallel to and transverse to the longitudinal axis of the metal base which sometimes leads to lamp failure and/or difficulty in removing the lamp from a lamp socket, luminaire or other current supply device. Such cracks can also originate at the stake holes of lamp bases that are attached to the lamp envelope by a staking method. This also represents a potential safety hazard to a user/installer. If a base breaks off in a socket, the power to the socket must be turned off before the broken base part can be removed and a new lamp installed. Various platings over the brass, such as nickel, zinc and copper have been tried and sometimes have resulted in a small increase of the base life and concomitant lamp life in such environments, but the results have not been satisfactory.

Consequently, a need exists for metal lamp bases which are resistant to natural and man-made corrosive environments and which do not exhibit cracks in service or in storage.

SUMMARY OF THE INVENTION

The present invention relates to lamp bases which are fabricated from copper alloys and which are resistant to cracking in corrosive environments. In one embodiment the lamp bases will be fabricated from a high copper content copper alloy comprising copper in an amount of at least about 94 wt. % along with at least one other metal selected from the group consisting essentially of Cd, Zn, Fe, P, Zr, Sn, Co, Si, Al, Cr and mixture thereof. Preferably the lamp bases in this embodiment will be fabricated from a high copper content copper alloy containing at least about 96 wt. % Cu along with at least two other metals selected from the group consisting essentially of Fe, P, Sn and mixture thereof. In another embodiment the lamp bases will be fabricated from a relatively high nickel content copper alloy containing at least about 60 wt. % Cu and at least about 8 wt. % Ni and, optionally, Zn in an amount of less than about 10 wt. %. Preferably the lamp bases in this embodiment will be fabricated from a relatively high nickel content copper alloy containing at least about 85 wt. % Cu, at least about 8.5 wt. % Ni and a metal selected from the group consisting esentially of Fe and Sn present in said alloy in an amount less than about 3 wt. %.

Thus, the present invention also relates to an electric lamp comprising an outer envelope of vitreous material having a stem or neck-shaped portion at one end thereof which terminates in a base portion, with a substantially metal lamp base provided on said base portion of said envelope and an electric light source accommodated in said envelope connected to said metal base by current supply conductors, wherein in one embodiment said metal base is fabricated from a high copper content copper alloy containing at least about 94 wt. % Cu along with at least one other metal selected from the group consisting essentially of Cd, Zn, Fe, P, Zr, Sn, Co, Si, Al, Cr and mixture thereof, and preferably, fabricated from a high copper content copper alloy containing at least about 96 wt. % Cu along with at least two other metals selected from the group consisting essentially of Fe, P, Sn and mixture thereof. In another embodiment, the lamp will contain a base fabricated from a relatively high nickel content copper alloy containing at least about 60 wt. % Cu and at least about 8 wt. % Ni and, optionally, at least Zn in an amount of less than about 10 wt. %. Preferably in this embodiment, the lamp will contain a base fabricated from a relatively high nickel content copper alloy containing at least about 85 wt. % Cu, at least about 8.5 wt. % Ni and a metal selected from the group consisting essentially of Fe and Sn present in said alloy in an amount less than about 3 wt. %.

DETAILED DESCRIPTION

Figure 1:
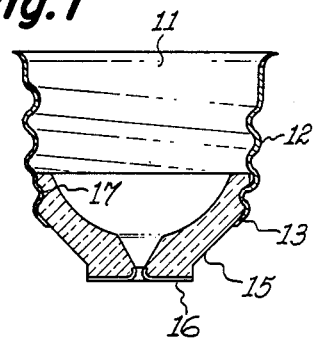
FIG. 1 is a cross-sectional illustration of a screw base structure according to the present invention.

As set forth above, the present invention relates to metal bases for electric lamps and electric lamps employing same wherein said metal bases are fabricated from copper alloys and wherein said bases are resistant to cracking in corrosive environments. In one embodiment the bases will be fabricated from a high copper content copper alloy containing at least about 94 wt. % Cu along with at least one other metal selected from the group consisting essentially of Cd, Zn, Fe, P, Zr, Sn, Co, Si, Al, Cr and mixture thereof. Preferably the bases in this embodiment will be fabricated from a high copper content copper alloy containing at least about 96 wt. % Cu along with at least two other metals selected from the group consisting essentially of Fe, P, Sn and mixture thereof. One particularly preferred high copper content copper alloy consists essentially of Cu and Cd with the aggregate amount of Cu and Cd present in an amount at least about 99.90 wt. % and with the amount of Cd present ranging between about 0.05–0.30 wt. %. Another particularly preferred high copper content copper alloy contains at least about 97.0 wt. % Cu along with Zn, Fe and P wherein the amount of Zn, Fe and P present in said alloy ranges between about 0.05–0.20 wt. %, 2.1–2.4 wt. % and 0.015–0.15 wt. %, respectively. This alloy can also contain Pb in an amount not exceeding about 0.03 wt. %.

In another embodiment the bases will be fabricated from a relatively high nickel content copper alloy containing at least about 60 wt. % Cu and at least about 8 wt. % Ni and, optionally, Zn in an amount of less than about 10 wt. %. Preferably the bases in this embodiment will be fabricated from a relatively high nickel content copper alloy containing at least about 85 wt. % Cu, at least about 8.5 wt. % Ni and a metal selected from the group consisting essentially of Fe and Sn present in said alloy in an amount less than about 3 wt. %. A particularly preferred base according to this embodiment will be fabricated from a relatively high nickel content copper alloy containing at least about 85 wt. % Cu, at least about 9.0 wt. % Ni and Fe in an amount ranging between about 1.0–1.5 wt. %. Such alloys can also contain, on an optional basis, one or more additional alloying metals selected from the group consisting essentially of Pb, Zn, Mn and mixture thereof with the aggregate amount of these three metals present in the alloy not exceeding about 2.5 wt. %.

Thus, electric lamps according to the present invention comprise an outer envelope of vitreous material having a stem or neck-shaped portion at one end therof which terminates in a base portion, with a substantially metal lamp base provided on said base portion of said envelope and an electric light source accommodated in said envelope connected to said metal base by current supply conductors, wherein in one embodiment said metal base is fabricated from a high copper content copper alloy containing at least about 94 wt. % Cu along with at least one other metal selected from the group consisting essentially of Cd, Zn, Fe, P, Zr, Sn, Co, Si, Al, Cr and mixture thereof, and preferably fabricated from a high copper content copper alloy containing at least about 96 wt. % Cu along with at least two other metals selected from the group consisting essentially of Fe, P, Sn and mixture thereof. A particularly preferred lamp according to this embodiment will contain a metal base fabricated from a high copper content copper alloy which consists essentially of Cu and Cd with the aggregate amount of Cu and Cd present in an amount of at least about 99.90 wt. % and with the amount of Cd present ranging between about 0.05–0.30 wt. %. Another particularly preferred high copper content copper alloy for lamp bases for lamps according to this embodiment will contain at least about 97.0 wt. % Cu along with Zn, Fe and P wherein the amount of Zn, Fe and P present in said alloy ranges between about 0.05–0.20 wt. %, 2.1–2.4 wt. % and 0.015–0.15 wt. %, respectively. This alloy can also contain Pb in an amount not exceeding about 0.03 wt. %.

In another embodiment the electric lamps of this invention will have bases fabricated from a relatively high nickel content copper alloy containing at least about 60 wt. % Cu and at least about 8 wt. % Ni and, optionally, Zn in an amount of less than about 10 wt. %. Preferably the lamps according to this embodiment will have metal bases fabricated from a relatively high nickel content copper alloy containing at least about 8.5 wt. % Cu, at least about 8.5 wt. % Ni and a metal selected from the group consisting essentially of Fe and Sn present in said alloy in an amount less than about 3 wt. %. a particularly preferred lamp according to this embodiment will contain a metal base fabricated from a relatively high nickel content copper alloy containing at least about 85 wt. % Cu at least about 9.0 wt. % Ni and Fe in an amount ranging between about 1.0–1.5 wt. %. Such alloys can also contain, on an optional basis, one or more additional alloying metals selected from the group consisting essentially of Pb, Zn, Mn and mixture thereof with the aggregate amount of these three metals present in the alloy not exceeding about 2.5 wt. %.

It has been found that metal lamp bases invariably contain residual or internal stresses as a result of the forming process, and in the case of a copper alloy lamp base, such stresses result in failure of the material either in storage or in service through stress-corrosion cracking. One of the primary corrosive agents has been found to be ammonia in combination with humid environments. Copper alloys such as high zinc content cartridge brasses are sensitive to stress corrosion cracking, even in the presence of relatively minor amounts of ammonia. This stress-corrosion cracking exhibits itself as cracks either more or less parallel to or transverse to the longitudinal axis of the base, which leads to lamp failure and/or difficulty in removing the lamp from a socket or other current supply device. Although it is theoretically possible to stress relieve such bases before they are assembled onto a lamp envelope, this is often not practicable. Also, stresses are induced when a base is assembled onto the stem or neck portion of a lamp envelope. Accordingly, the lamp bases according to the present invention have relatively high resistance to such stress-corrosion cracking.

FIG. 1 represents a typical construction of a screw type metal base commonly used for electric lamps. Referring to FIG. 1, metal base shell 11, fabricated from a copper alloy according to the present invention, has a threaded portion 12 and a flange end portion 13 which is turned or rolled inwardly to provide a reduced diameter opening for receiving insulator 15. Insulator 15 is formed from any suitable non-conductive material such as ceramic, glass, or plastic. The insulator is molded or shaped by any suitable means known in the art to produce a button-like article having one or more apertures depending upon the number of filaments in the lamp, and having a cylindrical portion merged with a conical portion terminated in a plateau for receiving one or more conductive metal contacts, such as metal contact 16. Metal contact 16 may be fabricated from a copper alloy according to the present invention and comprises a disc having a hole for receiving one of the leads from a filament (in the case of an incandescent lamp) or an arc tube electrode (in the case of an arc discharge lamp) which may then be soldered or welded thereto. Contact 16 may be conveniently attached to insulator 15 by flaring the hole therein to engage the corresponding hole in insulator 15. The cylindrical portion of insulator 15 contains an annular groove or undercut 17. While illustrated in FIG. 1 as having a semicircular cross section, undercut 17 may have any suitable cross section, depending upon how insulator 15 is to be attached to shell 11.

In fabricating such bases, conductive contact 16 is attached to insulator 15 by any suitable means, such as described above. Insulator 15 is then inserted into shell 11 so that the conical portion thereof engages flange 13 to provide a self-centering seating action. Shell 12 is then rolled or turned against a suitable tool to deform a portion of the shell to engage undercut 17 about the perimeter thereof. As previously noted, by using a mechanically assembled base, shell 11 may comprise thinner material. However, the work hardening of the metal, resulting from a blank being formed into the base shell, increases the chances of damaging the shell during subsequent reworking and also increases its susceptability to stress corrosion cracking. Forming the bead against undercut 17 supports the metal with reduced risk of damage to the shell. Thus, undercut 17 provides two functions: locking the insulator in place and supporting the metal during the deformation thereof to engage insulator 15.

Yet another way to fabricate such bases which is widely used in commercial practice at the present time is to form metal shell 11 and contact 16 which are then positioned in the appropriate spatial relationship with respect to each other, with insulation 15 then being formed in-situ from glass, plastic or other suitable material as is known to those skilled in the art.

Illustrative, but non-limiting examples of various types of lamp bases useful in accordance with the present invention include screw and non-screw types and bases that are screwed, cemented, staked or otherwise attached to the lamp envelope. Illustrative, but non-limiting examples of metal lamp bases useful in accordance with the present invention may be found, for example, in U.S. Pat. Nos. 3,775,634; 4,020,382; 4,044,277 and 4,496,874 the disclosures of which are incorporated herein by reference.

Figure 2:
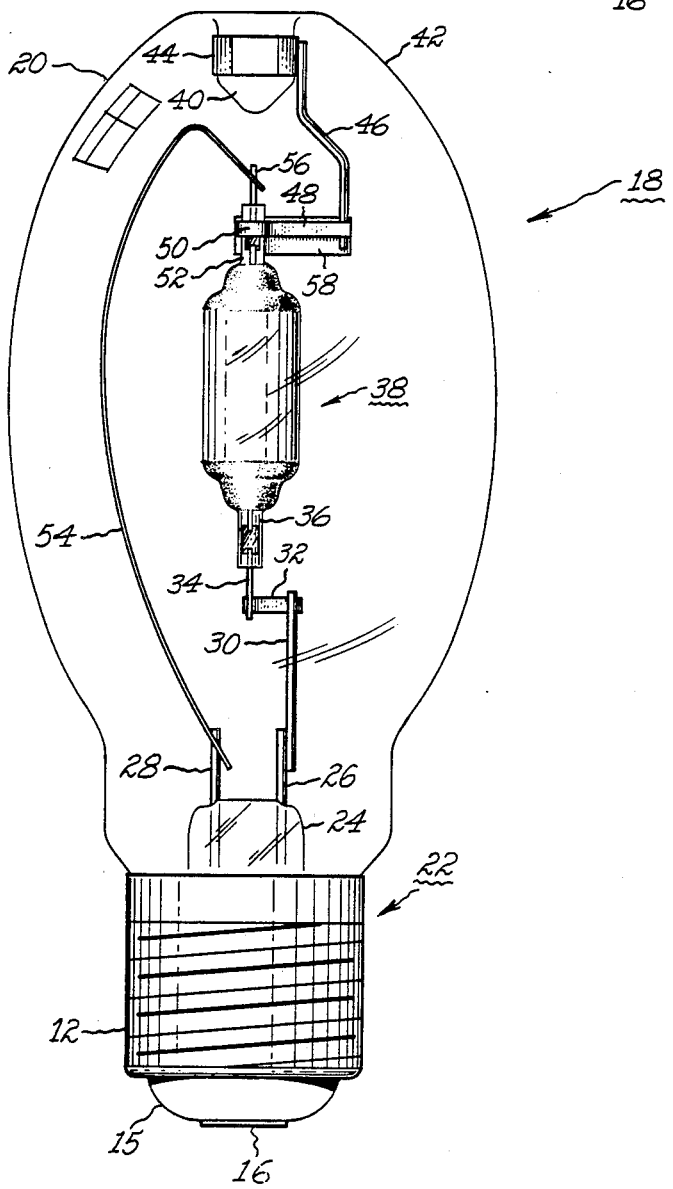
FIG. 2 is a schematic illustration of a metal halide lamp having a metal screw base fabricated from a copper alloy according to the present invention.

Referring now to FIG. 2, lamp 18 includes an outer envelope 20 of vitreous material, such as glass having a composition suitable for a high intensity discharge lamp, and a base 22 having suitable electrical contacts for making electrical connection to an appropriate source of electrical power. Base 22 includes a metal shell 12 made of a copper alloy according to the present invention, insulator portion 15 and metal contact disc 16. The space within the envelope 12 may be evacuated or filled with nitrogen gas. The end cap 14 surrounds the stem 24 of the outer envelope through which electrically conductive terminal wires 26 and 28 extend. Terminal 26 is connected to one end of support rod 30 for example by welding. An electrically conductive member 32 is attached to the opposite end of support rod 30 and is connected to one of the electrically conductive inleads 34 which extends through arc tube stem 36 of arc tube 38. An anchoring dimple 40 is provided at the closed end 42 of the outer envelope 20. A metallic collar 44 may be disposed around dimple 40 and connected, e.g. by welding, to one end of support rod 46 whose other end is attached, e.g. by welding, to support member 48 which includes a ring 50 surrounding arc tube stem 52 to provide support for the arc tube 38 within the outer envelope 20. An electrically conductive lead wire 52 is connected, e.g. by welding, to terminal 28 at one end and is connected, e.g by welding, to electrically conductive inlead 56 which passes through stem member 52 of the arc tube 38. A getter strip 58 coated with a material to absorb hydrogen and water vapor from the inside of the outer envelope 20 may be attached, for example by welding, to support rod 46.

Figure 3:
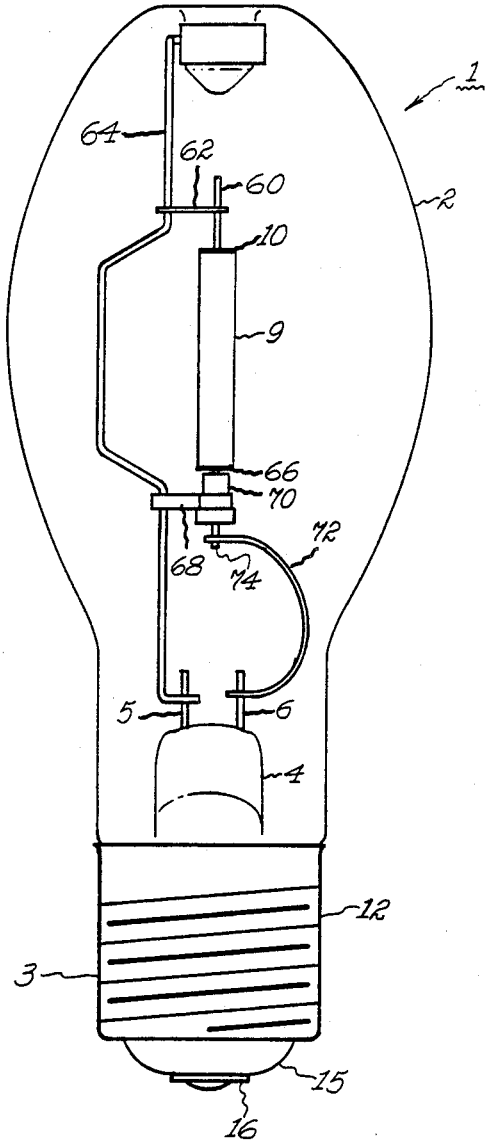
FIG. 3 is a schematical illustration of a high pressure sodium lamp having a metal screw base fabricated from a copper alloy according to the present invention.

FIG. 3 is a schematic illustration of a high pressure sodium gas discharge or arc lamp 1 comprising a vitreous outer envelope 2 having a standard mogul screw base 3 according to the present invention attached to one by a re-entrant stem press seal 4 through which extends a pair of relatively heavy lead-in conductors 5 and 6, whose outer ends are connected to the metal screw shell 12 and the eyelet or disc 16 of the base. Shell 7 and, optionally, eyelet 16 are fabricated from a copper alloy according to the present invention. Insulator portion 15 electrically insulates shell 7 from disc or eyelet 16. The inner envelope or arc tube 9, centrally located within said outer envelope, comprises a closed length of light-transmitting polycrystalline alumina ceramic tubing, which is translucent. The upper end of said arc tube is hermetically sealed by a polycrystalline alumina end closure member 10, through which extends a niobium in-lead wire 60 also hermetically sealed to said end closure member which supports an electrode (not shown) contained within the arc tube. The external portion of in-lead 60 connects to a transverse support wire 62 attached to a side rod member 64. Lower end closure member 66 for said arc tube has a central aperture through which extends a bottom electrode (not shown). The hermetically sealed arc tube is physically supported in the outer envelope by a metal ribbon 68 which is welded to side rod 62, but electrically isolated from the arc tube by an insulating bushing 70. A second lead-in conductor 72 is electrically connected to niobium in-lead wire 74 for the lower electrode.

The foregoing is meant to be illustrative and should not be taken as limiting the present invention in any way. Thus, although only a typical metal halide and sodium vapor lamp have been briefly described, those skilled in the art will know the present invention also applies to double ended as well as single ended lamps, to incandescent lamps, automotive or PAR lamps, tungsten-halogen lamps, tubular quartz heat lamps, etc.

The invention will be further understood by reference to the Examples below.

EXAMPLES

In the following Examples, an ammonium chloride stress corrosion test was employed which comprised a closeable glass vessel, such as a desiccator vessel or simple glass trough with ground rim and lid having a volume generally of at least about 10 liters to maintain a ratio of test space to volume of test solution of about 20:1 to 10:1. The test solution was an alkaline solution of ammonium chloride. In the preparation of, for example, 1 liter of ammonium chloride corrosion test solution, 107 g of reagent grade ammonium chloride was dissolved in about 750 ml of distilled or demineralized water to which was added as much of a 30% sodium hydroxide solution, prepared from reagent grade sodium hydroxide and distilled or demineralized water, as was necessary to reach a pH value of 10. In general, this required about 250 ml of 30% NaOH solution.

In conducting a stress corrosion test, specimens to be tested were suspended in such closed vessels over the ammonium chloride solution in a manner such that they did not contact either the test solution or each other. All of the stress-corrosion tests so conducted in the Examples below were done for a time period of 24 hours and at a temperature of 30° C.

Example 1

In this example, a number of lamps were made having metal mogul screw bases of the general type disclosed in FIG. 1, fabricated from various copper alloys wherein said bases had an overall diameter of 39.5 mm (1.55 inches) and an overall length of 42.5 mm (1.66 inches). The bases were screwed onto the lamp bases at an aggravated torque of about 35 inch-pounds. These lamps were placed in ammonium chloride-containing desiccators at 30° C. for 24 hours as indicated above and the results of such tests are set forth in the Table below. In all cases the stress relief occurred at the temperature so indicated for each of the alloys set forth below for a time by placing same in an oven for 5 minutes at a temperature indicated prior to screwing same on to the base of the lamp.

| Test | Lamp Base Alloy and Stress Relief Conditions | No. Tested | No. Failures |
|---|---|---|---|
| 1 | Alloy 260 Control Bases (750 F Stress Rel.) | 30 | 30 |
| 2 | " 194 not-stress relieved | 30 | 0 |
| 3 | " " " " " NP | 29 | 0 |
| 4 | " 650° F. (5 minutes) | 30 | 0 |
| 5 | " " " " " NP | 30 | 0 |
| 6 | " 750° F. | 30 | 0 |
| 7 | " " " " " " NP | 30 | 0 |
| 8 | " 706 not- " " | 36 | 0 |
| 9 | " " 650° F. " " | 36 | 0 |
| 10 | " " 750° F. " " | 28 | 0 |

Note:
NP means that the copper alloy base was nickel plated after the stress relief.

The alloy 260 is a high zinc content cartridge brass type of copper alloy having a nominal composition of 70 wt. % Cu and 30 wt. % Zn. The alloy 194 has a nominal composition of 97.4 wt. % Cu, 2.4 wt. % Fe, 0.13 wt. % Zn, and 0.04 wt. % P, and which may also contain Pb in an amount not exceeding about 0.03 wt. %. The alloy 706 has a nominal composition of 88.6 wt. % Cu, 1.4 wt. % Fe, 10 wt. % Ni and, optionally, Pb, Zn and Mn in amounts not exceeding about 0.05, 1.0 and 1.0 wt. %, respectively.

One can see from the stress corrosion results that all of the lamp bases fabricated from the 260 copper alloy failed the test, while those fabricated from the high copper content 194 and 706 alloys all passed the test.

Example 2

In this Example, a number of metal halide vapor (MV) and high pressure sodium (HPS) arc discharge lamps made by a lamp manufacturer other than GE were purchased, placed in desiccators for the 24 hour stress-corrosion test at 30° C., and then removed from the desiccators and examined for cracks at the rim portion of each base where it contacted the lamp envelope and also for any cracks in or parallel to the screw threads. Analysis of the metal lamp bases indicated that the bases had been fabricated from a high zinc content type of cartridge brass copper alloy 260 referred to in the previous Example. The results are set forth in the Table below.

TABLE II

| Lamp Type | Wattage | Rim Crack | Thread Crack |
|---|---|---|---|
| HPS | 50 | Yes | Yes |
| HPS | 50 | Yes | Yes |
| MV | 175 | Yes | No |
| MV | 175 | No | No |
| MV | 175 | Yes | No |
| MV | 175 | Yes | No |
| MV | 175 | Yes | No |
| MV | 175 | Yes | No |
| MV | 250 | Yes | No |
| MV | 250 | Yes | Yes |
| MV | 400 | Yes | Yes |
| MV | 400 | Yes | Yes |
| MV | 400 | Yes | Yes |
| MV | 400 | Yes | Yes |
| MV | 400 | Yes | Yes |

What is claimed is:

1. A substantially metal base for an electric lamp wherein said base is fabricated from a high copper content copper alloy comprising copper in an amount of at least about 94 wt. % along with at least one other metal selected from the group consisting essentially of Cd, Zn, Fe, P, Zr, Sn, Co, Si, Al, Cr and mixture thereof.

2. The base of claim 1 wherein said alloy comprises at least about 96 wt. % Cu along with at least two other metals selected from the group consisting essentially of Fe, P, Sn and mixture thereof.

3. The base of claim 1 wherein said alloy consists essentially of Cu and Cd with the aggregate amount of Cu and Cd present in an amount of at least about 99.90 wt. % and with the amount of Cd present ranging between about 0.05–0.30 wt. %.

4. The base of claim 1 wherein said copper alloy comprises at least about 97.0 wt. % Cu along with minor amounts of Zn, Fe and P.

5. The base of claim 4 wherein the amount of Zn, Fe and P present in said alloy ranges between about 0.05–0.20 wt. %, 2.1–2.4 wt. % and 0.015–0.15 wt. %, respectively.

6. The base of claim 5 wherein said alloy also contains Pb in an amount not exceeding about 0.03 wt. %.

7. A substantially metal base for an electric lamp wherein said base is fabricated from a relatively high nickel content copper alloy comprising copper in an amount of at least about 85 wt. % along with at least about 8.5 wt. % Ni and a metal selected from the group consisting essentially of Fe and Sn.

8. The base of claim 7 wherein said metal selected from the group consisting essentially of Fe and Sn is present in said alloy in an amount of less than about 3 wt. %.

9. The base of claim 7 wherein said relatively high nickel content copper alloy comprises at least about 85 wt. % Cu, at least about 9.0 wt. % Ni, and Fe in an amount ranging between about 1.0–1.5 wt. %.

10. The base of claim 9 wherein said alloy also contains one or more additional alloying metals selected from the group consisting essentially of Pb, Zn, Mn, and mixture thereof.

11. The base of claim 10 wherein said additional alloying metal or metals is present in said alloy in an aggregate amount not exceeding about 2.5 wt. %.

12. An electric lamp comprising an outer envelope of vitreous material having a stem or neck-shaped portion on at least one end thereof which terminates in a base portion, with a substantially metal lamp base provided on said base portion of said envelope and an electric light source accommodated in said envelope connected to said metal base by current supply conductors, wherein said metal base is fabricated from a high copper content copper alloy comprising copper in an amount of at least about 94 wt. % along with at least one other metal selected from the group consisting essentially of Cd, Zn, Fe, P, Zr, Sn, Co, Si, Al, Cr and mixture thereof.

13. The lamp of claim 12 wherein said alloy comprises at least about 96 wt. % Cu along with at least two other metals selected from the group consisting essentially of Fe, P, Sn and mixture thereof.

14. The lamp of claim 12 wherein said alloy consists essentially of Cu and Cd with the aggregate amount of Cu and Cd present in an amount of at least about 99.0 wt. % and with the amount of Cd present ranging between about 0.05–0.30 wt. %.

15. The lamp of claim 12 wherein said copper alloy comprises at least about 97.0 wt. % Cu along with minor amounts of Zn, Fe and P.

16. The lamp of claim 15 wherein the amount of Zn, Fe and P present in said alloy ranges between about 0.05–0.20 wt. %, 2.1–2.4 wt. % and 0.015–0.15 wt. %, respectively.

17. The lamp of claim 16 wherein said alloy contains Pb in an amount not exceeding about 0.03 wt. %.

18. An electric lamp comprising an outer envelope of vitreous material having a stem or neck-shaped portion on at least one end thereof which terminates in a base portion, with a substantially metal lamp base provided on said base portion of said envelope and an electric light source accommodated in said envelope connected to said metal base by current supply conductors, wherein said metal base is fabricated from a relatively high nickel content copper alloy comprising copper in an amount of at least about 85 wt. % along with at least about 8.5 wt. % Ni and a metal selected from the group consisting essentially of Fe and Sn.

19. The lamp of claim 18 wherein said metal selected from the group consisting essentially of Fe and Sn is present in said alloy in an amount of less than about 3 wt. %.

20. The lamp of claim 18 wherein said relatively high nickel content copper alloy comprises at least about 85 wt. % Cu, at least about 9.0 wt. % Ni, and Fe in an amount ranging between about 1.0–1.5 wt. %.

21. The lamp of claim 20 wherein said alloy also contains one or more additional alloying metals selected from the group consisting essentially of Pb, Zn, Mn, and mixture thereof.

22. The lamp of claim 21 wherein said additional alloying metal or metals is present in said alloy in an aggregate amount not exceeding about 2.5 wt. %.

23. A substantially metal base for an electric lamp wherein said base is fabricated from a relatively high nickel content copper alloy comprising copper in an amount of at least about 60 wt. %, nickel in an amount of at least 8 wt. % and zinc in an amount of less than about 10 wt. %.

24. An electric lamp comprising an outer envelope of vitreous material having a stem or neck-shaped portion on at least one end thereof which terminates in a base portion, with a substantially metal lamp base provided on said base portion of said envelope and an electric light source accommodated in said envelope connected to said metal base by current supply conductors, wherein said metal base is fabricated from a relatively high nickel content copper alloy comprising copper in an amount of at least about 60 wt. %, nickel in an amount of at least about 8 wt. % and zinc in an amount of less than about 10 wt. %.

* * * * *